US006045255A

United States Patent [19]

Ogier

[11] Patent Number: 6,045,255

[45] Date of Patent: Apr. 4, 2000

[54] PREWETTING MIXER

[75] Inventor: Ray Ogier, Milton, Canada

[73] Assignee: Chem Financial, Inc., Canada

[21] Appl. No.: 09/078,832

[22] Filed: May 14, 1998

Related U.S. Application Data

[60] Provisional application No. 60/046,656, May 16, 1997.

[51] Int. Cl.[7] ..... B01F 15/02

[52] U.S. Cl. ..... 366/165.2; 366/178.2

[58] Field of Search ..... 366/165.1, 165.2, 366/165.4, 165.5, 178.1, 178.2, 137.1

[56] References Cited

U.S. PATENT DOCUMENTS

| | | | |
|---|---|---|---|
| 2,224,355 | 12/1940 | Moller . | |
| 3,782,695 | 1/1974 | Sandiford . | |
| 4,086,663 | 4/1978 | Croft | 366/154 |
| 4,531,673 | 7/1985 | Holland et al. . | |
| 4,616,935 | 10/1986 | Harrison et al. | 366/165 |
| 4,688,945 | 8/1987 | Brazelton et al. | 366/156 |
| 4,778,280 | 10/1988 | Brazelton | 366/136 |

FOREIGN PATENT DOCUMENTS

| | | | |
|---|---|---|---|
| 1420306 | 1/1976 | United Kingdom | 366/165.1 |
| 96/32185 | 10/1996 | WIPO . | |

OTHER PUBLICATIONS

Ingersoll–Dresser Pumps, Cameron Hydraulic Data, pp. 2–8 –2–9, 1995.

*Primary Examiner*—W. L. Walker
*Assistant Examiner*—Marianne Ocampo
*Attorney, Agent, or Firm*—Gifford, Krass, Groh, Sprinkle, Anderson & Citkowski, P.C.

[57] ABSTRACT

A prewetting apparatus for mixing dry material with a liquid before mixing. The wetting apparatus has a cylindrical upper chamber mounted above a lower mixing chamber. The lower mixing chamber has a conic surface with an outlet below. Pressurized liquid is introduced from a housing which extends circumferentially about an upper portion of the lower section. Liquid is introduced through apertures into a groove at the upper edge of the conic surface at a predetermined flow rate and pressure so as to swirl helically down the conic mixing surface to exit at the outlet. Dry particulate matter is metered through an inlet formed in the upper cylindrical portion and is dropped at a predetermined rate into the liquid swirling in the mixing section.

4 Claims, 2 Drawing Sheets

PREWETTING MIXER

This application claims priority from Provisional Application Ser. Number 60/046,656, filed May 16, 1997.

BACKGROUND OF THE INVENTION

I. Field of the Invention

A prewetting mixer for use with powder mixing apparatus, and more particularly, a prewetting mixer having a mixing cone and pressurized fluid chamber.

II. Description of the Prior Art

It is known to use prewetters where the powder is blown or dropped into a stream of liquid which flow in a cone where the slurry is swirled to an outlet formed at the bottom of the cone. However, the mixing of powder or dry material with liquid often results in clotting. Additionally, it is very difficult to impart sufficient energy to the liquid and powder to produce a homogenous mixture with proper particle size.

Accordingly, it would be desirable to provide a mixing system which can impart energy without overly taxing the outside energy demands which are necessary in order to improve the mixing process. It is also desirable to provide a prewetting system which can be used with all types of powder material, including polymers before emulsification, fatty acids or any type of dry powdered chemical.

SUMMARY OF THE PRESENT INVENTION

These objects and others are achieved by a prewetting apparatus having a lower chamber with a conic surface which receives a stream of liquid which is injected through orifices having a predetermined size into the conic mixing surface. Liquid is injected to swirl helically down the mixing surface and to exit an outlet at the bottom of the cone. Dry particulate matter is dropped from an upper chamber at a predetermined rate into the liquid swirling on the mixing surface. A Teflon sleeve is used to line the inner chamber to prevent adhesion of particulate matter to the wall of the upper chamber. A housing forms a circumferential chamber extending around the upper portion of the cone to receive pressurized liquid. The orifices are formed in a ring to inject the liquid into a slot at the upper edge of the cone. The slot has a wall to prevent the liquid from being sucked into the upper chamber as a result of pressure differential and prematurely mixing with the powder.

DESCRIPTION OF THE DRAWING

A better understanding of the present invention will now be had upon reference to the following detailed description, when read in conjunction with the accompanying drawing, wherein like reference characters refer to like parts throughout the several views, and in which.

DETAILED DESCRIPTION OF THE PRESENT INVENTION

Figure 1:
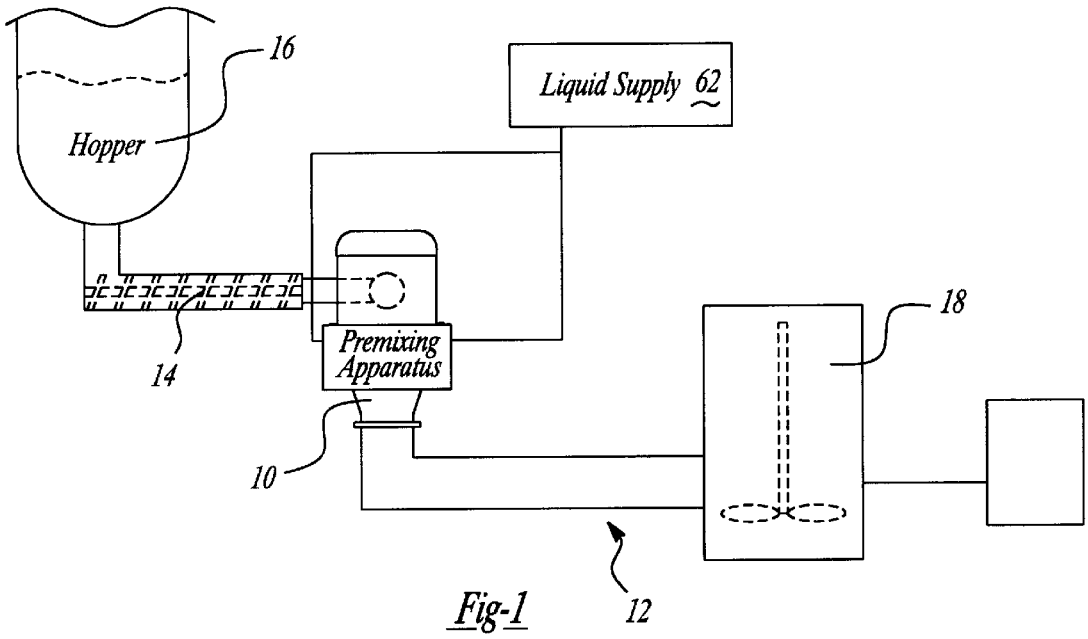
FIG. 1 is a schematic view of a mixing system having a premixing apparatus in accordance with the invention.

As shown in FIG. 1, a static premixing apparatus 10 in accordance with the invention is shown for use with a powder mixing system 12. The mixing system 12 includes a delivery device 14, such as a feed screw for delivering dry particulate matter or powder, from a hopper 16 to the premixing apparatus 10. The premixing apparatus 10 is connected to a mixing device 18 suitable for mixing the powder material such as an agitator pump or an eductor pump. The premixing apparatus 10 of the invention can be used for mixing any powder or particulate material and can be incorporated into any mixing system to improve the quality and efficiency of the system.

Figure 2:
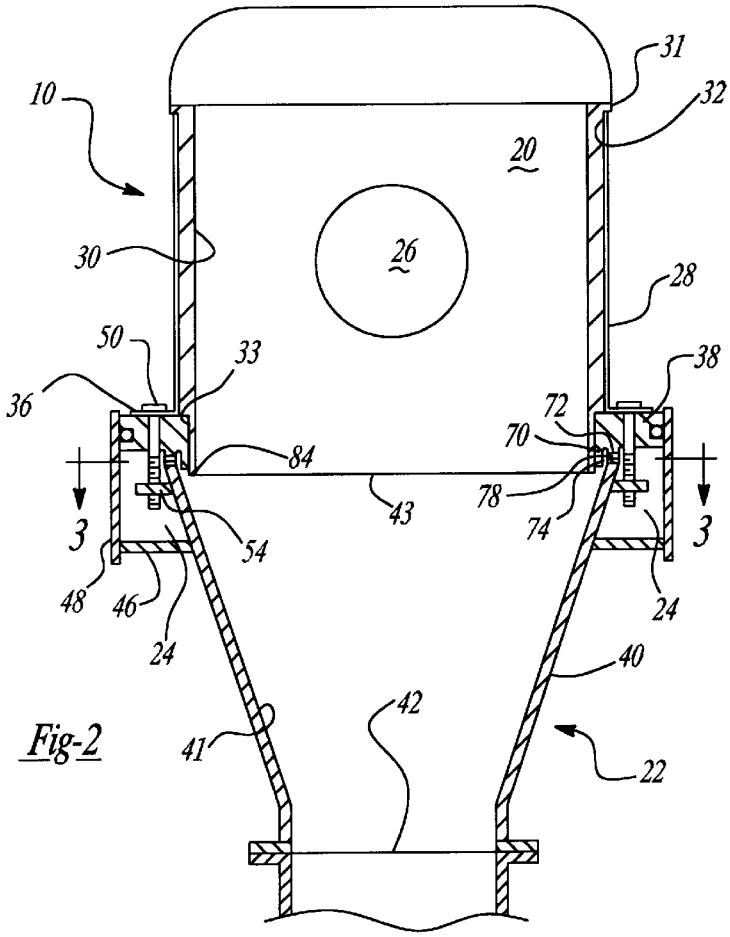
FIG. 2 is a cross-sectional view of the premixing apparatus in accordance with the invention.

As shown in FIG. 2, the premixing apparatus 10 includes an upper chamber 20, a lower mixing chamber 22, and an intermediate annular chamber 24 for pressurized liquid. The upper chamber 20 has an inlet 26 centrally disposed in a cylindrical side wall 28 for receiving the dry material from the metering feed screw 14. Optimally, the dry material is metered to drop at a predetermined rate from the inlet 26 directly into the lower mixing section 22. At the bottom of the side wall 28 is an outwardly extending circumferential flange 36 for mounting to a delivery ring 38 and the lower mixing chamber 22. The side wall 28 of the upper chamber is lined with a Teflon sleeve 30 extending from a top edge 32 of the chamber 20 to below the flange 36 of the side wall 28. The Teflon sleeve 30 extends between a flange 31 at the top and a bottom end 84. The flange 31 extends radially outwardly to engage the top edge 32 of the side wall 28 to position the sleeve 30. An annular groove 33 is formed about the bottom end of the sleeve beneath the flange 36 of the side wall 28. The Teflon sleeve 30 is used to protect particulate matter from adhering to the side wall 28 of the upper chamber.

As shown in FIG. 2, the lower chamber 22 includes a cone 40 having an outlet 42 centrally formed in the bottom of the cone. The cone 40 has an inner mixing surface 41 extending between a top edge 43 and the outlet 42.

Figure 4:
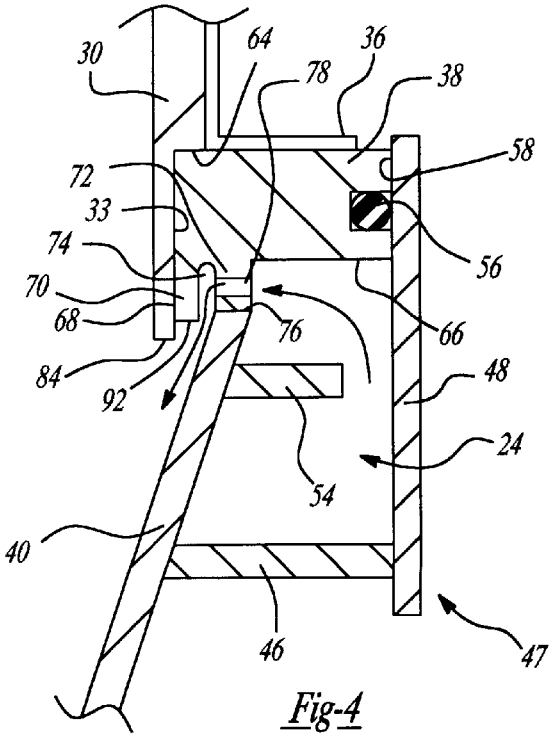
FIG. 4 is a partial cross-sectional view of the intermediate fluid chamber taken along lines 4—4 of FIG. 5.

As shown in FIG. 4, the fluid chamber 24 is defined by the delivery ring 38 and housing 47 which includes an annular flange 46 and cylindrical wall 48 which extend about an upper portion of the lower chamber. The mixing ring 38 extends radially between the groove 33 on the Teflon sleeve 30 and the cylindrical wall 48 beneath the flange 36 of the upper chamber 20. The upper chamber 20 and ring 38 are mounted to the cone 40 by bolts 50 which pass through the flange 36, apertures 52 in the ring 38, to engage threaded bores formed in gears 54 extending outwardly from the lower chamber 22 within the fluid chamber 24. An O-ring 56 is mounted in an outer edge 58 of the ring 38 to seal the fluid chamber 24.

Figure 3:
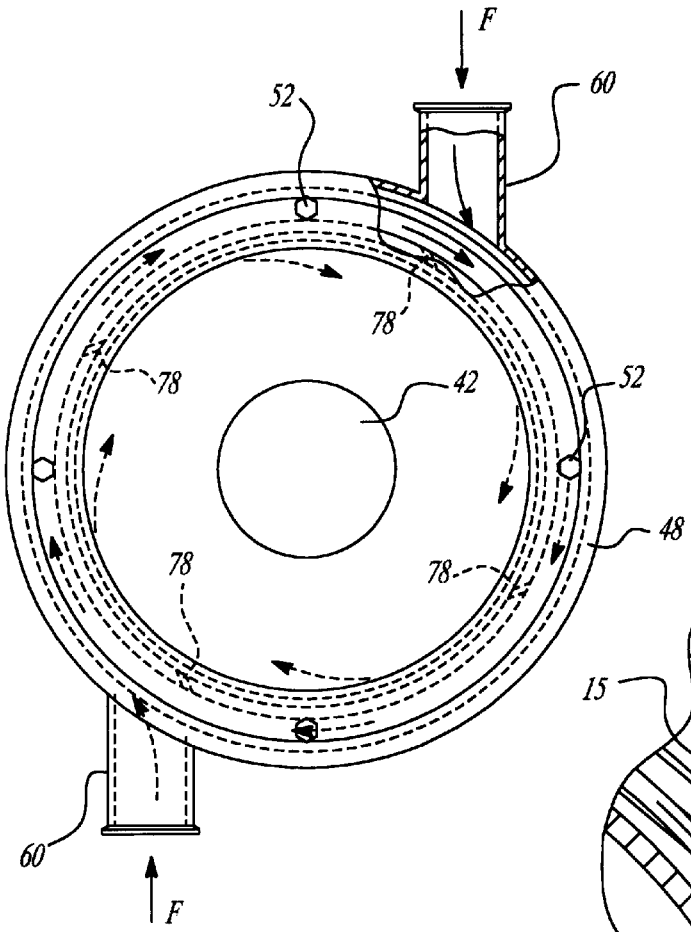
FIG. 3 is a sectional view of an injection ring taken along lines 3—3 of FIG. 2 of a premixing apparatus as part of the system.

As shown in FIG. 3, pressurized liquid, such as water, is delivered to the fluid chamber 24 by a pair of diametrically opposed inlets 60 formed in the cylindrical wall 48 and connected to a liquid supply 62. The liquid is delivered as shown by the arrows "F" to provide a clockwise flow of liquid in the chamber 24.

As shown in FIG. 4, the mixing ring 38 has a planar top surface 64 spaced apart from a lower surface 66 by the outer edge 58 and an inner cylindrical surface 68. The cylindrical surface 68 extends beyond the lower surface to form an inner flange 70. An outer flange 72 is spaced radially outwardly from the inner flange 70 to form an annular groove 74. The outer flange 72 is positioned to extend from an upper edge 76 of the cone 40 and define a portion of the chamber 24. The groove 33 of the sleeve 30 is received within the cylindrical surface 68 of the mixing ring 38.

Figure 5:
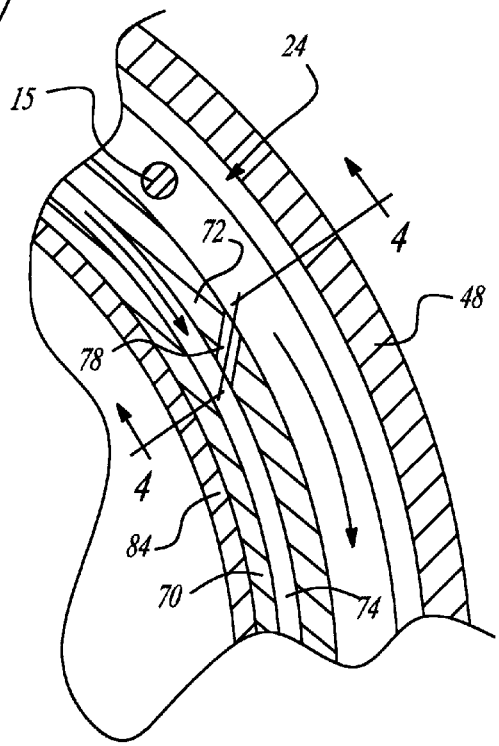
FIG. 5 is a fragmentary enlarged top view of a portion of the ring.

As shown in FIGS. 3, 4 and 5, four circular orifices 78 are formed through the outer flange 72 to direct a stream of the pressurized liquid from the chamber 24 into the annular groove 74 between the flanges 70, 72.

As shown in FIG. 5, the orifices 78 are formed at an angle less than 90°, to the tangential direction of the flow of liquid in the chamber at the orifice 78. The orifices 78 are sized in accordance with the materials to be mixed. The formulas for calculating the size of the orifices 78 are set forth in "Cameron Hydraulic Data" which is incorporated by reference herein. The liquid is thus introduced as a pressurized stream into the groove 74 at a predetermined flow rate and pressure.

The liquid flows from the groove 74 between the mixing surface of the cone and a lower edge 92 of the inner flange 70 and the bottom edge 84 of the sleeve 30. The bottom edge 84 of the sleeve 30 extends slightly below the lower edge 92 of the inner flange 70. Thus, liquid from the chamber 24 exits the orifices 78 into the annular groove 74 and is pulled downwardly by gravity to swirl down the mixing surface 41 of the cone 40 to the outlet 42. Because there is lower pressure in the upper chamber 20 than in the groove 74, a pressure differential exists which would draw the fluid into the upper chamber 20. The bottom end 84 of the sleeve restricts an upward flow of the liquid into the upper chamber 20 to prematurely contact the powder material.

The powder or granular matter falls down from the inlet 26 to the mixing surface 41 of the cone 40 where it contacts the swirling liquid. The mixture of powder and liquid is carried helically in a counter-clockwise direction around the mixing surface 41 and downwardly to mix the powder with the liquid before it exits the outlet 42. Because the liquid is under a predetermined high pressure when it exits the orifices 78, it has been found that control of the particle size is better controlled and clotting is reduced when compared with previously known prewetting devices.

Having described my invention, many different embodiments will become apparent to one skilled in the art to which the invention pertains without deviating from the scope of the disclosure as set forth in the appended claims.

I claim:

1. A prewetting apparatus for mixing dry material with a liquid, said apparatus comprising:

a cone having an inner mixing surface extending between an upper portion and a bottom, said bottom having an outlet;

a housing defining a circumferential chamber mounted to said cone for delivering pressurized liquid through at least one orifice formed in an outer flange of said housing, said housing also having an inner flange spaced radially inwardly from said outer flange and forming a groove therebetween, said chamber forming an enclosed fluid passage extending circumferentially around said cone, said fluid flowing in a circle in said chamber, said chamber aligned on a plane which extends radially with respect to said inner flange, said at least one orifice extending inwardly alone said plane through said outer flange at a predetermined angle of less than 90°, said at least one orifice delivering pressurized liquid from said chamber into said groove above said upper portion of said cone to swirl downwardly to said outlet;

an upper chamber disposed above said cone having an inlet for receiving said dry material and dropping said material into said liquid swirling along said inner mixing surface of said cone, said inner flange extending below said at least one orifice to prevent mixing of said liquid with said dry material in said upper chamber.

2. The prewetting apparatus of claim 1, wherein said housing further comprises a ring mounted above said cone.

3. The prewetting apparatus of claim 1, wherein said upper chamber further comprises an inner surface formed of Teflon.

4. The prewetting apparatus of claim 1, wherein said upper chamber has an inner surface extending downwardly beyond a lower edge of said inner flange to prevent an upflow of liquid.

* * * * *

UNITED STATES PATENT AND TRADEMARK OFFICE

CERTIFICATE OF CORRECTION

PATENT NO. : 6,045,255
DATED : April 4, 2000
INVENTOR(S) : Ray Ogier

It is certified that error appears in the above-identified patent and that said Letters Patent is hereby corrected as shown below:

Column 4, line 7 - Replace "alnoe" with -- along--

Signed and Sealed this

Fifth Day of June, 2001

*Attest:*

*Attesting Officer*

Nicholas P. Godici

NICHOLAS P. GODICI

*Acting Director of the United States Patent and Trademark Office*

UNITED STATES PATENT AND TRADEMARK OFFICE

CERTIFICATE OF CORRECTION

PATENT NO. : 6,045,255
DATED : April 4, 2000
INVENTOR(S) : Ray Ogier

It is certified that error appears in the above-identified patent and that said Letters Patent is hereby corrected as shown below:

Column 4,
Line 17, replace "alone" with -- along --.

Signed and Sealed this

Ninth Day of October, 2001

*Attest:*

Nicholas P. Godici

*Attesting Officer*

NICHOLAS P. GODICI
*Acting Director of the United States Patent and Trademark Office*